United States Patent [19]

Kaiser et al.

[11] 3,951,784

[45] Apr. 20, 1976

[54] FINE POWDER CLASSIFICATION BY FERROFLUID DENSITY SEPARATION

[75] Inventors: Robert Kaiser, Winchester; Leon Mir, Brookline, both of Mass.; Richard A. Curtis, Seattle, Wash.

[73] Assignee: Avco Corporation, Cincinnati, Ohio

[22] Filed: Jan. 29, 1975

[21] Appl. No.: 545,128

[52] U.S. Cl. ..... 209/1

[51] Int. Cl.[2] ..... B03B 13/04

[58] Field of Search..... 252/62.56, 62.51, 62.52; 209/1, 172.5

[56] References Cited

UNITED STATES PATENTS

| | | | |
|---|---|---|---|
| 3,483,968 | 12/1969 | Kaiser | 209/1 |
| 3,784,471 | 1/1974 | Kaiser | 252/62.56 X |
| 3,843,540 | 10/1974 | Reimers et al. | 252/62.56 X |

OTHER PUBLICATIONS

Kaiser et al., "Magnetic Properties of Stable Dispersions of Subdomain Magnetite Particles," *Journal of Applied Physics*, Vol. 41, No. 3, pp. 1064–1072.

*Primary Examiner*—Frank W. Lutter
*Assistant Examiner*—Ralph J. Hill
*Attorney, Agent, or Firm*—Charles M. Hogan; Abraham Ogman

[57] ABSTRACT

A method of separating small diameter non-magnetic particles of different densities by using a low magnetic saturation ferrofluid and a high magnetic gradient to produce levitation by overcoming the magnetic attraction of the particles.

Application of a constant gradient field of a level below the magnetic saturation level of the ferrofluid forms the ferrofluid into a density gradient column. Each non-magnetic particle levitates to the level inside the ferrofluid having the same apparent density as the particle.

The ferrofluid contains magnetic particles with a mean effective core diameter less than about 50 angstroms and a stabilizing agent layer on the particle exceeding about 50 angstroms. Perfluorinated carriers and surfactants are preferred for their relatively high intrinsic density.

6 Claims, 9 Drawing Figures

FINE POWDER CLASSIFICATION BY FERROFLUID DENSITY SEPARATION

BACKGROUND OF THE INVENTION

1. Field of the Invention

The present invention relates generally to methods for separating fine powder or particles of different densities and more specifically to a method for separating of such particles using the levitational properties of a ferrofluid.

2. Description of the Invention

There exist standard methods of separating two or more solids which depend on the differences in the densities of the components. The most common method involves sink-float separation in a liquid medium. Sink-float separation operates on the principle that when two objects of different density are immersed in a fluid of intermediate density, the less dense will float and the more dense will sink. The separation is completed by individually removing the two solid fractions. While simple in principle, solids separation by the classical sink-float method has a number of severe shortcomings. These include:

a. Pure liquids or solutions do not cover the range of densities of interest. Most liquids have low densities whereas most solids have high densities. There are very few materials that are liquid at ambient temperature and exhibit a density greater than 2 gr/cm$^3$.

b. An accurate sink-float separation is obtained only if there is complete liberation of the different particles in the solid mixture. It is necessary to ensure that a sample of very fine particles is well dispersed in the sink-float medium. Otherwise, agglomerates will behave as individual particles with a density intermediate between those of the ultimate particles in the agglomerate, thereby resulting in poor separation.

c. The density of a given liquid is a constant value which is not readily varied. Changes in temperature will only result in small variations in the liquid density. In order to obtain different density cuts, it is necessary to carry out a series of sink-float separations in different liquids of varying densities.

Use of a ferrofluid and a magnetic field to create an apparent high ferrofluid density permits sink-float separation of non-magnetic solids according to their density. Some of the problems outlined above are resolved by the controlled density aspect of ferrofluids.

Ferrofluids are stable colloidal dispersions of superparamagnetic particles (diameter ($d$) $\simeq$ 0.01 microns). These dispersions retain their liquid properties in a magnetic field. By proper choice of stabilizing agents, magnetic properties can be conferred to a wide range of liquids which include water, hydrocarbons and fluorocarbons. These colloidal dispersions form a unique class of magnetic liquids in which it is possible to induce substantial magnetic body forces. One of the unusual properties of a ferrofluid is that its apparent density may be made significantly greater than its true physical density by the application of a magnetic field. With a properly designed electromagnet, the apparent density of a ferrofluid may be varied from less than 1 gr/cm$^3$ to more than 25 gr/cm$^3$, thereby permitting flotation of any element in the periodic table. The concepts involved are more fully discussed in U.S. Pat. Nos. 3,483,968; 3,483,969; and 3,488,531, which are commonly assigned to the assignee hereof and are incorporated herein by reference.

A variation of sink-float separation in a liquid of constant density is the classification of particles according to their densities in a density gradient column. In a density gradient column, the density of the liquid increases with depth; the liquid at the top of the pool is less dense than the liquid at the bottom of the pool. A density gradient can be established either by imposing a temperature gradient on a pure liquid, adding heat at the top of the pool and removing it at the bottom, or by having a concentration gradient. In the latter case, two miscible liquids of different density are added in variable proportions along the length of the column. The concentration of the denser liquid increases with column depth.

Density gradient classification or sink-float separation have the drawbacks alluded to above for classic sink-float separation and additional difficulties as well: (a) any mixing or turbulence destroys the density gradients, irreversibly in the case of columns based on a concentration gradient; (b) preparing and maintaining a gradient column is difficult to accomplish. Introducing and removing solid particles without upsetting the density gradient is difficult.

However, ferrofluids would seem well suited to creation of a stable variable density fluid through appropriate application of magnetic forces. Moreover, a density gradient system is superior for classifying fine particles.

SUMMARY OF THE INVENTION

The present invention applies the principles of ferrofluid separation to density gradient separation systems, and in particular, to classifying particles smaller than 5 mm. The present separation method uses a low magnetization ferrofluid having a low magnetic saturation (e.g. less than 100 gauss) in a magnetic field having a relatively high magnetic gradient (more than 100 oersted/centimeter) to achieve a density gradient effect capable of classifying non-magnetic particles having densities of 1–10 gm/cm$^3$ to levitation levels inside the ferrofluid consistent with their density.

The ferrofluid itself is different from the usual ferrofluid being formed from smaller particles, i.e., less than 50 A, and stabilizing agents that create thicker stabilizing agent layers, i.e., greater than 30 A. The particle concentration in the ferrofluid is usually low. Advantageously, the ferrofluid has been formed with a perfluorinated liquid carrier, because of the high intrinsic specific gravity of the perfluorinated liquids (e.g. 1.8).

OBJECTS OF THE INVENTION

An object of the present invention is to provide an improved method for separating small particles of different densities using the levitation technique of a ferrofluid separator.

A further object of the present invention is to provide a ferrofluid levitation separator for fine powders of different densities using a single fluid whose apparent density is controllable by a magnetic field.

Another object of the present invention is to incorporate the ferrofluid levitation theory used for macroscopic objects into a separator of particles by compensating for the magnetic attraction of the particles due to their small size.

An even further object of the present invention is to provide a method of separating small particles using a stable, non-toxic, high density ferrofluid.

An additional object of the present invention is to provide a novel class of ferrofluids.

Other objects, advantages and novel features of the present invention will become apparent from the following detailed description of the invention when considered in conjunction with the accompanying drawings.

DESCRIPTION OF THE PREFERRED EMBODIMENTS

Sink-float separators using ferrofluids have heretofore dealt with the separation of macroscopic objects (as exemplified by the three previously mentioned patents). Separation of fine powders involve a different design and mode of operation. A number of factors which can be neglected in separation of macroscopic objects must be taken into account to separate very fine particles according to their densities. These include the interaction of non-magnetic particles immersed in a ferrofluid in a magnetic field and the settling characteristics of fine particles in a viscous fluid. Within the context of this invention the line of demarcation between fine particles and macroscopic objects is taken (arbitrarily) to be about 1 mm in size (e.g. diameter).

In a ferrofluid separator, a body of ferrofluid is held between the poles of an electromagnetic which generates a magnetic field with a constant gradient; directed downward, in the direction of gravity. Consequently, a non-magnetic object immersed in the ferrofluid pool experiences a reverse force in the upward direction. By regulating the strength of the magnetic field gradient and the strength of the ferrofluid, this reverse magnetic force can be made larger or smaller than the force of gravity on the non-magnetic object. When the reverse magnetic force is larger than the force of gravity, the object will float even though its density is greater than the density of the ferrofluid. When the reverse magnetic force is less than the force of gravity, the object sinks.

In a suitable magnetic field with a gradient parallel to gravity, a ferrofluid can be viewed as a liquid that has a controllable apparent density:

$$\rho a = \rho F + \frac{M(H)\Gamma}{g}$$

where $\rho a$ = "apparent density" of the ferrofluid; gr/cm$^3$, $\rho F$ = physical or true density of ferrofluid; gr/cm$^3$, $M(H)$ = magnetic dipole moment of ferrofluid, emu; a function of the field strength, $H$, $\Gamma$ = vertical gradient of magnetic field; oersted/cm, $g$ = acceleration of gravity; cm/sec$^2$.

This theoretical development is based on the case of an isolated non-magnetic object immersed in a ferrofluid which is positioned in a magnetic field gradient and does not take into account any interaction between immersed objects.

In actual separation practice, the ferrofluid volume may contain many non-magnetic objects which are being separated from each other. The presence of these objects introduces perturbations in the externally applied magnetic field and its gradient. These perturbations result in particle-to-particle interaction forces.

An appreciation of the perturbations can be gained by analyzing likely interactions. For example, two adjacent non-magnetic spheres may be immersed in the ferrofluid side by side (as illustrated in FIG. 1A) or superposed as illustrated in FIG. 1B.

Figure 1A:
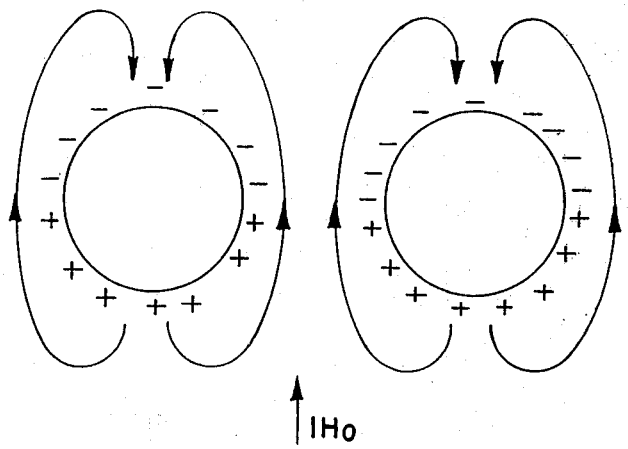
FIGS. 1A and 1B diagrammatically illustrate particle interaction inside a ferrofluid.
Figure 1B:
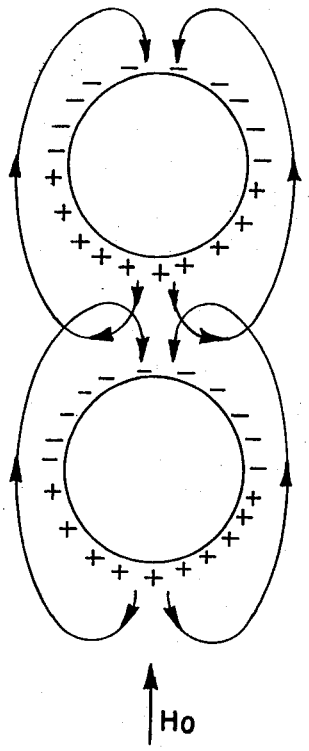

When the two spheres are in the configuration illustrated in FIG. 1A, the non-magnetic spheres cause an accumulation of positive "magnetic charge" on the sides facing the field and negative "magnetic charge" on the other sides. This charge in turn produces an additional magnetic field, some of whose field lines are drawn in FIG. 1. As this figure suggests, this perturbation field is in the same direction as the externally applied field, along a line joining the sphere centers, and is largest between them. Consequently, the ferrofluid which is of course attracted to regions of high magnetic field, moves into the region between the spheres, where the total sum of the external field and the perturbation field is highest. This movement of ferrofluid manifests itself as a repulsive force between the spheres of magnitude:

$$F_{xx} = 3 \left(\frac{VM}{d^2}\right)^2$$

where $V$ = volume of sphere, $M$ = magnetic dipole moment per unit volume of ferrofluid, $d$ = distance between sphere centers.

A similar analysis for the two superposed spheres whose line of centers is parallel to the direction of the externally applied field (FIG. 1B) shows that the spheres are subject to an attractive force of the same magnitude as the repulsive force of the first case. It is furthermore possible to show that this last configuration, with line of centers parallel to field direction, is the stable one, and that other initial configurations will drift to this stable one; which in the absence of other forces will eventually result in the mutual approach and touching of the spheres. The force is given by the following equation:

$$F_{xx} = \left(\frac{(4\pi M)^2}{96}\right) \left(\frac{D^6}{a^4}\right)$$

where $a$ = center to center spacing between particles, $D$ = diameter of the particles, $M$ = magnetic dipole moment per unit volume of ferrofluid.

When the spheres consist of the two types that are to be separated by magnetic levitation, the half the difference in the net levitation force between the spheres must be greater than the above attraction force if separation is to take place. Half the difference in levitation force, $F_1$, between two spheres of identical volume $V$ but different densities situated in a ferrofluid pool is given by:

$$F_1 = \tfrac{1}{2}(\rho 2 - \rho 1)\, g\, V$$

where $\rho 2$ = density of the more dense sphere, $\rho 1$ = density of the less dense sphere, $g$ = acceleration of gravity.

The dimensionless ratio $F_{ss}/F_1$, given by the following equation, should be an index of whether or not particle separation according to density will occur:

$$\frac{F_{ss}}{F_1} = \left(\frac{1}{8\pi}\right)\left(\frac{(4\pi M)^2}{(\rho 2-\rho 1)g}\right)\left(\frac{D^3}{a^4}\right) \quad (1)$$

This ratio should be as small as practical for good separation to occur. Consider the worst case, where the spheres touch and therefore $a = D$, $$\frac{F_{ss}}{F_1} = \left(\frac{1}{8\pi}\right)\left(\frac{(4\pi M)^2}{(\rho 2-\rho 1)\, gD}\right) \quad (2)$$

This relation shows that for a fixed value of the ratio $F_{ss}/F_1$, the magnetization of the ferrofluid must be reduced as the size of the spheres is reduced. The ferrofluids heretofore employed for macroscopic separations are not well adapted to reduced magnetization systems. The novel ferrofluids hereinafter described are more suitable. A further result is that the magnetic field gradient must be increased to compensate for the reduction of ferrofluid magnetization in order to attain a given apparent ferrofluid density sufficient to float the less dense objects.

The force ratio $F_{ss}F_1$ can also be calculated using the average interparticle distance as the measure of particle separation. The average interparticle distance ($a$) can be expressed in terms of the volume concentration of powder particles ($\epsilon v$) by:

$$\frac{a}{D} = \left(\frac{\pi}{6\epsilon v}\right)^{1/3} \quad (3)$$

assuming a cubic particle array. Thus, Equation (1) becomes, when $a$ is equated to $d$:

$$\frac{F_{ss}}{F_1} = \frac{(4\pi M)^2}{8\pi(\rho 2-\rho 1)\; gD}\left(\frac{6\,\epsilon\, v}{\pi}\right)^{4/3} \quad (4)$$

Equation (3) indicates that in actual practice particle concentration could have a significant effect on the quality of separation. This is a less severe criterion than Equation (2).

In order to test the validity of the theory of particle interactions, the effects of fluid magnetization and particle size on the separation of alundum ($\rho$ = 4.0 gr/cm$^3$) and silicon carbide ($\rho$ = 3.2, gr/cm ) powders were examined at a constant apparent density of about 3.6 gm/cm$^3$.

In these tests the relative concentration of powder in the ferrofluid was approximately 0.05 by volume. The fluid magnetization and magnetic field gradient were varied in a manner such that the resulting apparent density of the ferrofluid was intermediate between the densities of the two powders so that the silicon carbide should float and the alundum should sink. Since silicon carbide is black and alundum is white, the quality of the separation could be determined by visual examination of the separated fractions. The results as presented in Table I clearly show that: (a) for a given particle size, the separation improves as the magnetization of the ferrofluid is lowered; (b) for a given ferrofluid magnetization, the quality of separation increases with increasing particle size. For the first four runs a kerosene base ferrofluid was employed. Run 5 employed a fluorocarbon ferrofluid.

TABLE I

SEPARATION OF POWDERS BY MAGNETIC FLUID LEVITATION

Mixture Compositions:
Alundum: 59% by weight, $\rho$ = 4.0 gm/cm$^3$
Silicon Carbide: 41% by weight, $\rho$ = 3.2 gm/cm$^3$
Total Particle Concentration: $\epsilon v$= 0.05 volume fraction
Apparent Density of Ferrofluid: 3.6 gm/cm$^3$

| Size of Granules Mesh Range | Mean Diameter (Microns) | Fluid Saturation Magnetization, $4\pi M_s$ Gauss | Applied Magnetic Field Gradient, Γ oe/cm | Calculated Values of $F_{ss}/F_1$ A(Eq. 2) $a = D$ | B(Eq. 4) $a = d$ | Results |
|---|---|---|---|---|---|---|
| −30/+40 | 500 | 100* | 400 | 10.0 | .45 | Good separation |
| −30/+40 | 500 | 50** | 800 | 2.54 | .105 | Excellent separation |
| −50/+80 | 240 | 100 | 400 | 21:1 | .93 | Poor separation |
| −50/+80 | 240 | 50 | 800 | 5.3 | .23 | Good separation |
| −140/+200 | 90 | 25*** | 1050 | 3.5 | .153 | Excellent separation |

*true density — 0.86 gm/cm$^3$
**true density — 0.81 gm/cm$^3$
***true density — 1.79 gm/cm$^3$ (HFPO Decamer - FREON E-3 Ferrofluid)

The ratio $F_{ss}/F_1$ was first calculated according to Equation (2) where it is assumed that the particles come into physical contact. From these data, it appears that using a value of $F_{ss}/F_1 < 1$ calculated on the basis of Equation (2), may be too severe a criterion of whether or not separation will occur. In this equation, particle concentration is not taken into account. For example, in Run 2 of the foregoing example, there was excellent separation, even though the calculated value of $F_{ss}/F_1$ = 2.5, based on the mean particle diameter of the powder in the sample. Furthermore, this number is a conservative estimate because particles smaller than the mear, which have a larger value of $F_{ss}/F_1$ than the one calculated, will be the first to interact.

The ratio $F_{ss}/F_1$ may also be calculated on the basis of Equation (4), which assumes that the particles are uniformly spaced through the ferrofluid and that particle separation is a function of particle concentration. In all cases, even where there was relatively poor separation, the calculated values of $F_{ss}/F_1$ are less than unity. This indicates that computing a value of $F_{ss}/F_1<1$ based on an assumed mean particle separation is not stringent enough a criterion of the quality of separation. The value should be based upon assumed physical contact and for practice of this invention $F_{ss}F_1<10$, based upon an Equation (2) computation.

Reducing the volumetric concentration of particles in suspension results in improved separation. Decreasing the particle concentration decreases the average inter-particle separation. This not only decreases the average value of $F_{ss}$ but also decreases the probability of contact between two particles. At a sufficiently low concentration the probability of particle contact should be negligibly small. A balance exists between probability of contact and the fact that close encounters between powder particles, irrespective of the average separation, are those which will result in inter-particle attraction forces thus degrading the quality of separation.

A related factor which may arise in the operation of the device is the interaction of the powder particles with the walls of the separation vessel. An attractive force between a non-magnetic particle in a ferrofluid and the nonmagnetic wall (which can be treated as a sphere of large radius) can exist. By properly designing the magnetic field source, these forces can be cancelled by oppositely directed horizontal magnetic field gradients which would tend to push the particles away from the vessel walls.

When the mixture to be separated has a broad size distribution, pre-screening may be employed so as to remove the smaller particles, these being the portion that separate poorly because of interaction. Reference is made to related application Ser. No. 545,240, entitled "Classification by Ferrofluid Density Separation" by Richard A. Curtis, Robert Kaiser, and Leon Mir, filed concurrently herewith, as pertaining to sink/float separation of particles pre-screened to remove material whose presence causes $F_{22}/F_1>10$. However, prescreening to remove small particles leaves the art with the more difficult separation, i.e. the need to separate fine particle mixtures.

Figure 2:
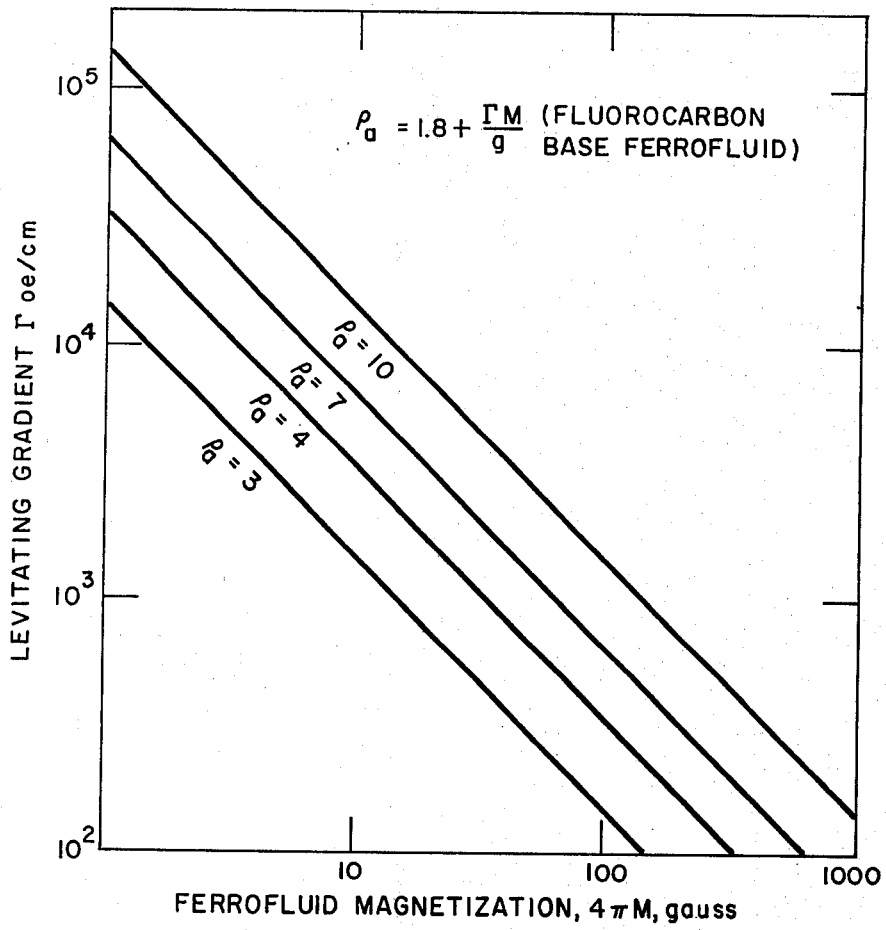
FIG. 2 is a graph of levitating gradient as a function of ferrofluid apparent density and ferrofluid magnetization.

The design of a fine particle separator will be determined by particle interaction effects. Such effects can be made small by using low magnetization ferrofluids and high field gradients. FIG. 2 shows the effect of ferrofluid apparent density and ferrofluid magnetization on intensity of levitating gradient.

Figure 3:
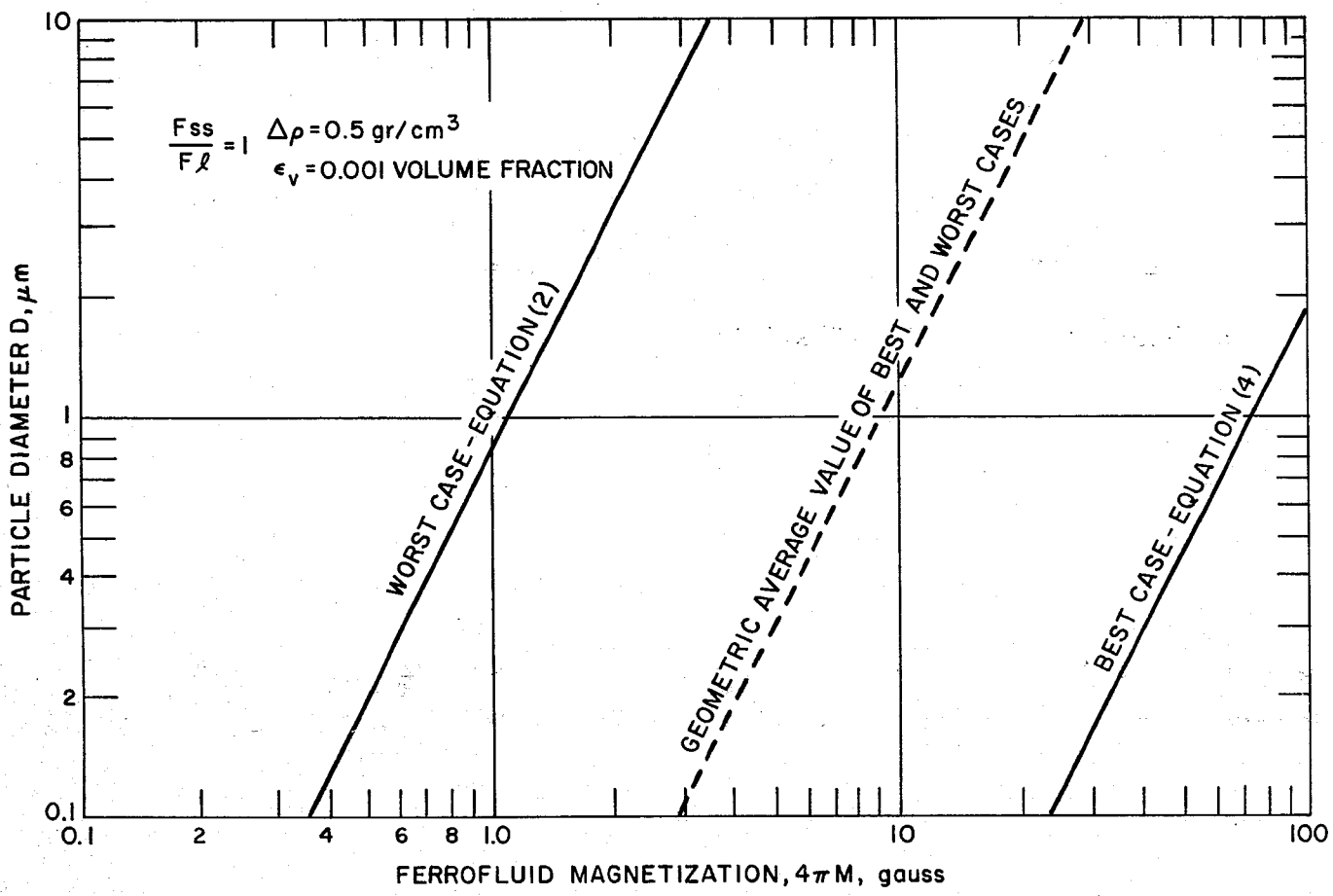
FIG. 3 is a graph of the ratio of $F_{22}/F_1$ as a function of particle size and ferrofluid magnetization.

The possible range of ferrofluid magnetization required to separate particles smaller than 10 $\mu$m in size, with a density discrimination of 0.5 gr/cm$^3$, is presented in FIG. 3. The range of the permissible values of ferrofluid magnetization as a function of particle size, for a value of $F_{ss}/F_1 = 1$ is bound by curves predicted by Equation (2) as the most pessimistic esitmate and by Equation (4) for a value of $\epsilon v = 0.001$, as the most optimistic estimate. The geometric mean of the extreme values is assumed as a probable operating line. According to this figure the separation of particles 10 $\mu$m in diameter, that differ in density by 0.5 gr/cm$^3$, will occur if ferrofluids with a magnetization of less than 4 gauss are used, but may actually occur, at the assumed particle concentration level, with ferrofluids with a magnetization of less than 30 gauss. For particles 1 $\mu$m in diameter, the corresponding magnetizations are approximately 1 gauss and 9 gauss.

Figure 4:
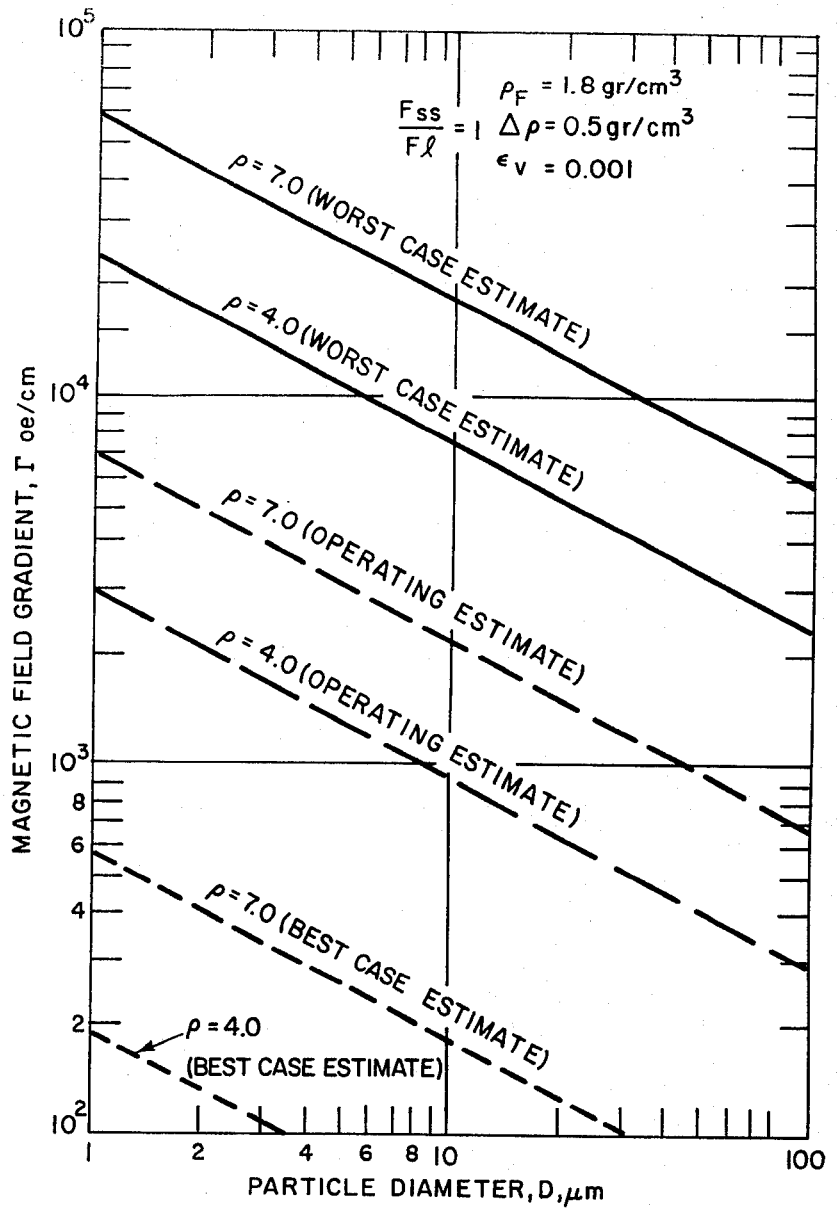
FIG. 4 is a graph of estimated magnetic gradient required for fine particle separation in a fluorocarbon ferrofluid.

The magnetic field gradient required to levitate particles of density 4 gr/cm$^3$ and 7 gr/cm$^3$, with a discrimination of 0.5 gr/cm$^3$ in a fluorocarbon ferrofluid of density of 1.8 gr/cm$^3$ is presented in FIG. 4 as a function of particle size. FIG. 4 is based on the values of $M$ predicted in FIG. 3. The worst case is based on the calculation of $M$ according to Equation (2), the best case is based on values of $M$ obtained from Equation (4), using a value of $\epsilon v = 0.001$. The operating estimate is based on the geometric mean of the above limiting values of $M$.

Using the geometric mean, it should be possible to carry out a separation of particles 10 $\mu$m or larger at a density level of 7 gr/cm$^3$ to within 0.5 gr/cm$^3$ with an applied gradient of 2200 oe/cm. In this instance, the corresponding ferrofluid magnetization is 29 gauss. Smaller particles will require the application of greater gradients. Under these conditions, gradients of 5000 oe/cm and 7000 oe/cm would be required for separations of 2$\mu$m and 1 $\mu$m particles, respectively. Lower gradients would be required to separate these particles at a lower density. At a density of 4.0 gr/cm$^3$ the required gradient for the separation of particles as small as 1 $\mu$m would be 3000 oe/cm.

This theoretical calculation indicates that the capabilities of existing laboratory separators, which can generate a maximum gradient of about 1000 oe/cm are not adapted to practice of this invention. With a suitable fluorocarbon ferrofluid such as is hereinafter described, it should be possible to separate, with a discrimination of 0.5 gr/cm$^3$, particles larger than about 50 $\mu$m at a density level of 7 gr/cm$^3$, particles larger than about 10 $\mu$m at a density level of 4 gr/cm$^3$, and still smaller particles at lower density levels.

It is possible to construct a magnet capable of generating gradients higher than 1000 oe/cm by modifying the design configuration disclosed in copending and commonly assigned application, "Hyperbolic Magnet Poles for Sink-Float Separators", filed Mar. 25, 1974, which is incorporated herein by reference by reduction of the size of the gap and the pole pieces. The scaling becomes nonlinear because of saturation of the iron yoke which also results in a maximum gap field of 20,000 oe. By modifying the yoke design to postpone yoke saturation until high gap fields are obtained and increasing the coil current density to provide more magnetizing force, it should be feasible to build a modified C frame with a mirror pole capable of generating a constant vertical gradient of about 5000 oe/cm over a vertical distance of about 1 inch (2.5 cm) with a gap width of about 1 inch. Horizontal gradients can be minimized by making the length large in comparison to the width of the gap (10:1) and applying appropriate trim pads at the edges.

With this magnet and a fluorocarbon ferrofluid, particles as small as 2 $\mu$m in diameter at an operating density of 7 gr/cm$^3$, or particles as small as 1 $\mu$m in diameter at an operating density of 5.5 gr/cm$^3$ might be classified. On the basis of the worst case estimate, FIG. 2 predicts that with a 5000 oe/cm magnet, particles larger than 20 $\mu$m at a density of 4 gr/cm$^3$ and particles larger than 100 $\mu$m at a density of 7 gr/cm$^3$ can be separated.

Vertical gradients in excess of 5000 oe/cm may require an iron-free field source. Even such gradients can be generated by using, for example, a super conducting split coil configuration.

All ferrofluids have the magnetic properties required for sink-float separation, and generally the many different ferrofluids heretofore suggested to the art are equivalent for macroscopic separation. However, for best classification of particles, attention must be paid to the ferrofluid itself.

Ferrofluids are very stable dispersions of single domain magnetic particles. The suspended particles are so small (typically less than 500 A) that they do not settle under gravity or interact even in the presence of a strong magnetic field. The magnetic response of a ferrofluid results from the coupling of individual particles with a substantial volume of the bulk liquid. This coupling is facilitated by a stabilizing agent which adsorbs on the particle surface and is also solvated by the surrounding liquid. This solvated layer is also responsible for the stability of the suspension. By proper choice of stabilizing agent, magnetic properties can be conferred to many liquids including fluorocarbons.

Figure 5:
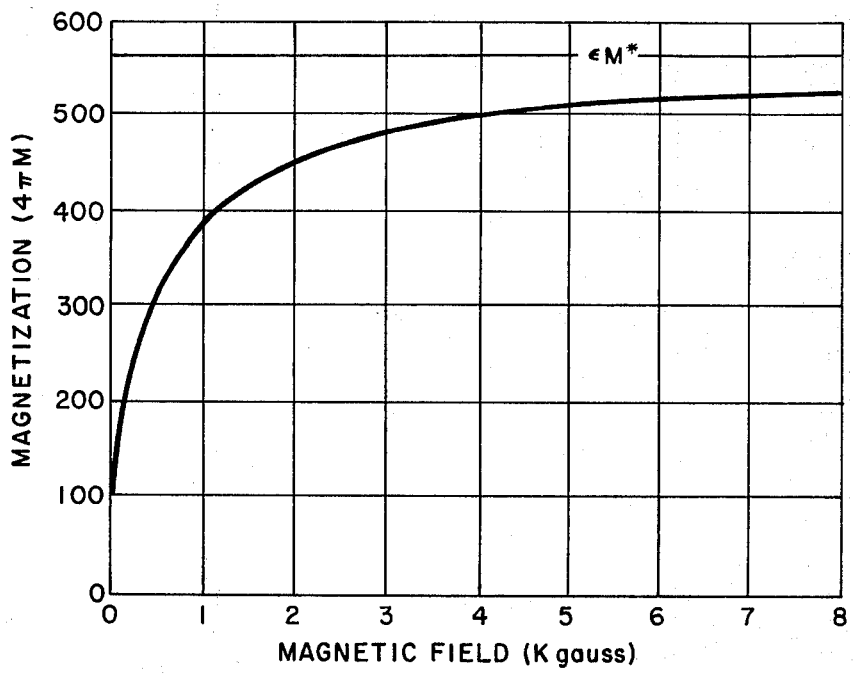
FIG. 5 is a graph of the magnetization curve of a typical ferrofluid.

The magnetic properties of a ferrofluid can best be described by considering the particles in a ferrofluid to behave as an assembly of non-interacting magnets. Their magnetic properties have been successfully correlated by superparamagnetic theory, taking into account the composition, size distribution, volume concentration and domain magnetization of the particles in suspension. In the absence of a magnetic field, they are randomly oriented and the ferrofluid has no net magnetization. In a magnetic field, the particles tend to align with the field resulting in a net induced fluid magnetization, $M$. The magnetization increases with increasing field until a saturation value is observed as shown in FIG. 5. Under these conditions the particle moments are all aligned in the direction of the applied field. As soon as the magnetic field is removed, the particles become randomly oriented again because of thermal motion. The ferrofluid, therefore, has no residual magnetization and does not exhibit hysteresis.

The saturation magnetization of a ferrofluid can be adjusted by varying the concentration of colloidal magnetite. Stable ferrofluids with saturation magnetizations, $4\pi M_s$, ranging from less than 1 gauss to over 1000 gauss have been prepared.

A ferrofluid remains a liquid in a magnetic field because the particles do not interact. A minor increase in viscosity (which can be made as small as desired) is noted because of the interaction of the particles with the field.

Even though the superparamagnetic particles in a ferrofluid do not interact in a magnetic field, there is a tendency for these particles to migrate under the influence of a strong field gradient. For most applications in which a ferrofluid is exposed to a gradient field for short periods of time (of the order of hours) and in which mixing of the ferrofluid may occur as a result of some convective mechanism, there are no noticeable spatial variations in ferrofluid properties even if the ferrofluid is used in magnetic fields high enough to provide saturation of the magnetization. This is because the rate of migration of the particles is very small.

The magnetic equivalent of Stokes Law for the sedimentation rate of a stabilized magnetic particle in a field gradient, T, is expressed by the following equation:

$$V_m = \frac{d_m^2}{18\,\eta\, o\left(1 + \frac{2S}{d_m}\right)}(M_d\,\Gamma)$$

where $V_m$ = settling velocity of ferrofluid particle $d_m$ = diameter of magnetic particle $S$ = thickness of the non-magnetic layers of a solvated particle (stabilizing particle film and the non-magnetic outer shell of the particle)

$M_d$ = magnetic moment of particle $\Gamma$ = applied gradient field $\eta\, o$ = carrier liquid viscosity For example, the velocity of a 100 A magnetite particle, stabilized by a solvated layer 50 A thick, is about $3.6 \times 10^{-7}$ cm/sec in a kerosene base ferrofluid ($\eta\, o$ = 0.02 cp) such as the one shown in FIG. 5, in a local magnetic field of $H$ = 5000 oe, and $\Gamma$ = 1000 oe/cm.

In applications where the fluid is exposed to a gradient field for an extensive period of time ($>10^6$ sec, for example) under quiescent, isothermal conditions, the effect of migration of the colloidal magnetic particles has to be taken into consideration. This effect can be minimized to any desired extent by decreasing the size of the suspended particles. With small enough particles, thermal diffusion becomes an effective mixing mechanism. For example, a local magnetic field with $M$ = 5000 oe and $\Gamma$ = 1000 oe/cm will result in a concentration gradient at equilibrium of less than a 2% change in particle concentration per cm for magnetite particles that have an effective magnetic diameter of 30 A. The time needed to approach equilibrium will also be very long because of the extremely slow migration velocity which is about $6 \times 10^{-9}$ cm/sec for the case considered above.

It is necessary therefore to consider the properties of the non-magnetic carrier liquid and stabilizing agents as well as the properties of the suspended magnetic particles. A ferrofluid for superior density classification of fine particles,, and particularly for particles less than 100 microns, should have the following properties:

1. The carrier liquid must be a good medium in which to disperse the sample which contains the particles of interest.
2. In order to minimize particle interaction effects, ferrofluids of low magnetization are required.
3. The ferrofluid must be stable in the high gradient fields required to levitate dense particles.
4. The superparamagnetic particles of the ferrofluid must be much smaller than any of the processed particles in the sample.

The above conditions are best met by using the ferrofluids having single domain particles of magnetite having a mean diameter not exceeding about 50 A. Such particles are smaller than normally result from extended grinding of coarser magnetic oxide powder, and are smaller by a factor of two or more than the particles employed in the experimental work that resulted in the previously mentioned three patents. The smaller particles can, however, be prepared by precipitation of single domain magnetic particles from solutions of mixed iron salts.

In addition, the stabilizing layer formed by adsorption or reaction, or whatever occurs on the surface of the magnetic particles must be relatively thick. For purposes of the present invention relatively large surfactant molecules are contemplated, large being defined as molecular configurations which form a solvated layer above about 30 A in length.

Low magnetization ferrofluids desirable for practice of this invention can be obtained by having a low concentration of magnetic particles in suspension, i.e. less than about 1% by volume. For example, a ferrofluid that contains 1% by volume magnetite ($M_d$ = 450 gauss) will have a saturation magnetization, $4\pi M_s$, of about 50 gauss. Ferrofluids of low magnetization are obtained by diluting a more concentrated ferrofluid of higher magnetic moment with additional carrier liquid. The dilution does not adversely affect the stability of the resulting product.

Perfluorinated ferrofluids are particularly well suited for practice of this invention and such ferrofluids are preferred, including notably perfluorinated ferrofluids prepared according to the teachings of U.S. Pat. No. 3,784,471. Superior perfluorinated ferrofluids are obtained when the magnetite particles are smaller than about 50 A $D_m$, and the stabilizing agent layer thickness exceeds about 50 A.

Briefly stated, the perfluorinated ferrofluids are stable dispersions of magnetite not exceeding about 50 A in size in a perfluorinated liquid carrier and a surfactant, said surfactant having the following formula:

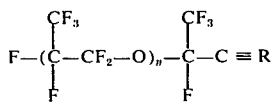

wherein $n$ is an integer of from 5 to 50, and wherein R is a member selected from the group consisting of:

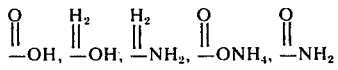

A preferred example of perfluorinated ferrofluid for practice of this invention is:

| Component | Composition | Concentration Volume Percent |
|---|---|---|
| Carrier liquid | FREON E-3 | Balance |
| Stabilizing agent | HFPO polymer carboxylic acid such as KRYTOX 157 | 1 |
| Magnetic colloid | Magnetite, $Fe_2O_3$ $d_m \simeq 30$ A | 0.2 |

Stable ferrofluids prepared with these fluorinated agents proved to be excellent inert, non-toxic, dispersing and classifying media for many solid materials.

FREON E-3 (E. I. DuPont de Nemours Co.) is hydrogen terminated trimer of hexafluoropropylene oxide. KRYTOX 157 (DuPont) is a hexafluoropropylene oxide polymer carboxylic acid with a high molecular weight (M.W. = 2500). When it adsorbs on a superparamagnetic particle, it is solvated by FREON E-3, resulting in a stabilizing layer. KRYTOX 157 molecules are quite large, of the order of 70 A. This large adsorbed layer increases the stability of the ferrofluid in a high gradient field.

The relatively high density of these fluorinated compounds ($\rho = 1.8$ gr/cm$^3$) is also a desirable property. A smaller magnetic force will be required to levitate a dense particle on a fluorocarbon base ferrofluid than in a hydrocarbon or water base ferrofluid, for example. For a given applied gradient a ferrofluid of lower magnetization will be required to float a denser particle, or vice versa.

Figure 6:
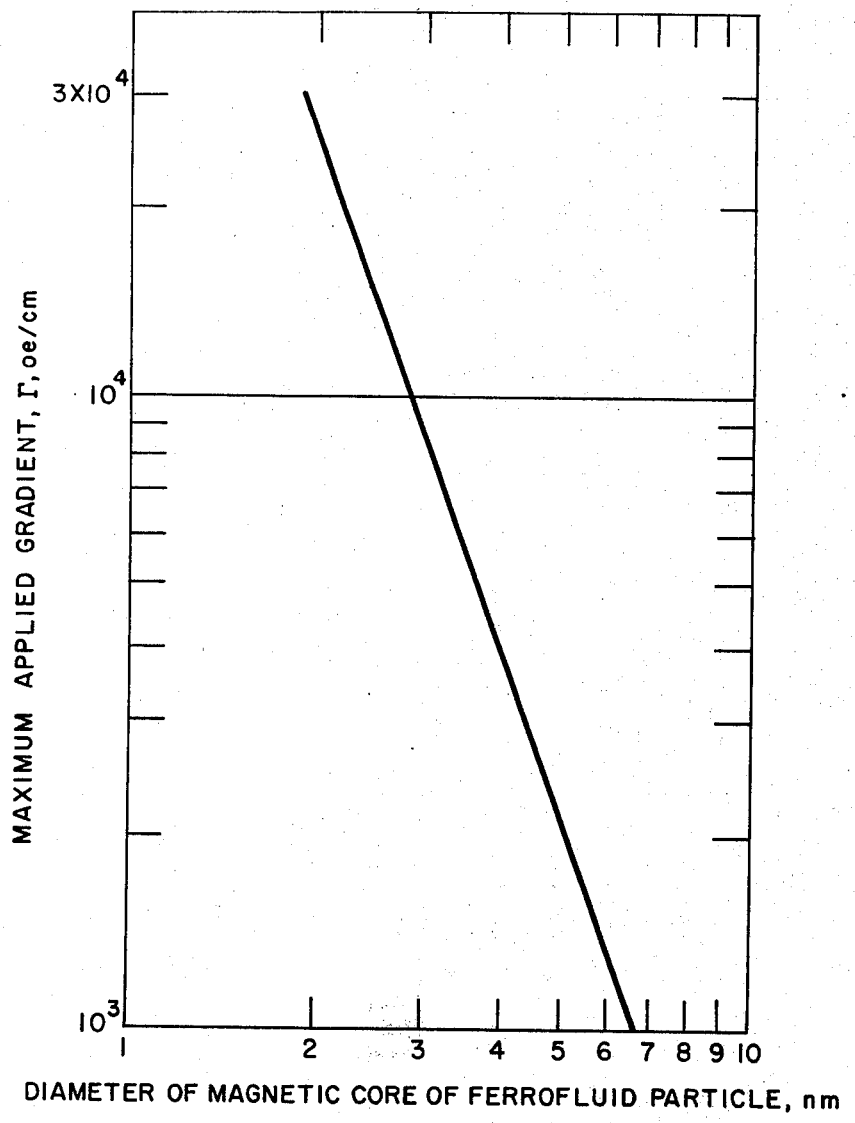
FIG. 6 is a graph of the size of superparamagnetic particles required for ferrofluid stabilization in high gradient fields.

The maximum magnetic gradient that can be applied will be limited by the stability of the ferrofluid (as well as more obvious considerations of practicality and cost of the field source and associated power supply) in the applied field over the time required for separation to occur. As has already been pointed out, the ferrofluid particles will tend to migrate under the influence of a strong field gradient at a velocity $V_m$. For the separator to operate, it is necessary that $V_m$ be much smaller than the minimum allowed settling velocity of the processed particles, which is calculated to be about $10^{-5}$ cm/sec. This establishes bounds on permissible values of $\Gamma$ and therefore, on the size of the particles that can then be separated. Everything else being constant, $V_m$ is a strong function of magnetic particle diameter, $d_m$, and the thickness of the non-magnetic layers of a solvated superparamagnetic particle. In a given gradient field, particles with a small magnetic core and a thick solvated shell will have a lower migration velocity in a given carrier liquid than a particle with a larger core and a thinner shell. FIG. 6 is a plot of the maximum field gradient that can be applied in a separator as a function of the size of the magnetic particles in the ferrofluid. This figure is for magnetite ($M_d$= 450 gauss) fluorocarbon base (FREON E-3, $\eta\ o$ = 0.05 poise) KRYTOX 157 stabilized ($S$ = 70 A) ferrofluid, assuming a maximum permissible value of $V_m = 10^{-7}$ cm/sec. On the basis of FIG. 6, applied gradients of about 7000 oe/cm may be required to levitate 1 $\mu$m particles with a density of 7 gr/cm$^3$. This would require an effective magnetic particle core diameter of less than about 35 A which corresponds to actual particle diameter of less than about 50 A.

Figure 7:
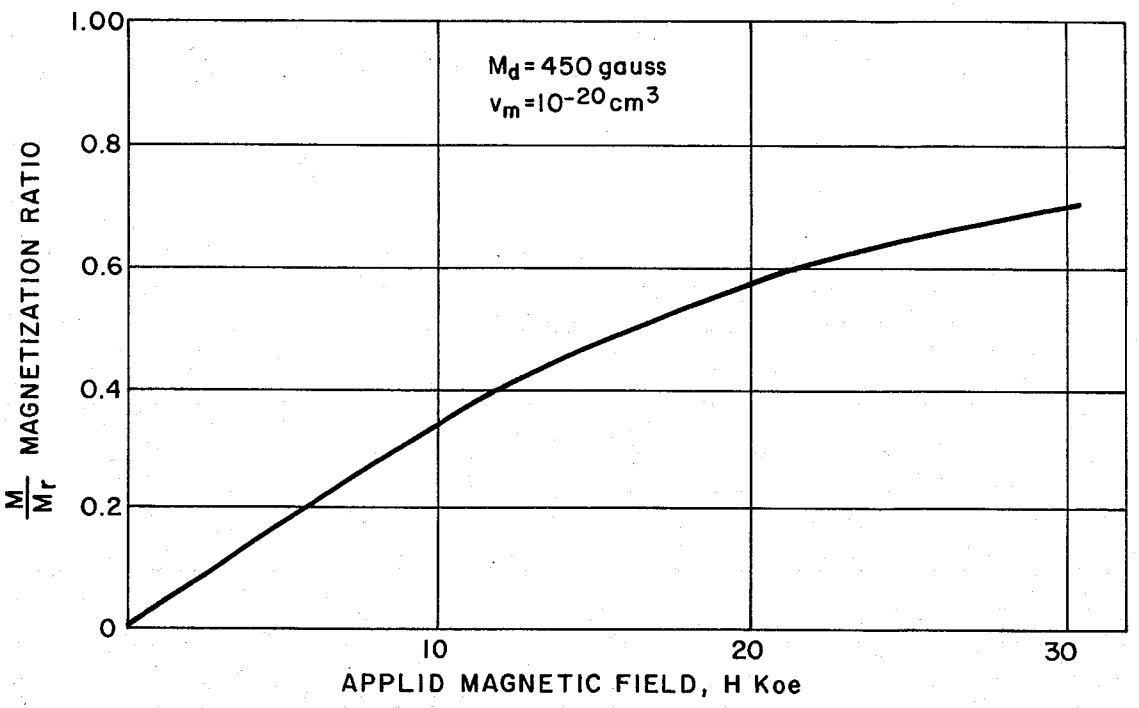
FIG. 7 is a graph of normalized magnetization curve of a ferrofluid for particle separation.

A ferrofluid formulated with particles of this size will require extremely high fields to approach saturation. FIG. 7 is a plot of Langevin function for magnetite particles ($M_d$= 450 gauss) with a magnetic particle core volume of $10^{-20}$ cm$^3$ ($d_m$ 20 A). In the range of applied fields that can be generated with an iron yoke magnet ($H \simeq 20$ K gauss) the ferrofluid magnetization increases essentially linearly with $H$. At $H = 20$ K gauss, the magnetization of the ferrofluid is less than 60% of its saturation value. The sharp contrast between FIG. 7 and FIG. 5 illustrates the superiority of preferred ferrofluids for particle separation under variable density circumstances.

In a constant gradient magnet, the apparent density of the ferrofluid at any point in the gap can be expressed by the following equation:

$$\rho fa = \rho f + \frac{\chi H \Gamma}{g}$$

where $\chi = M/H$, is the susceptibility of the ferrofluid which, at low field strengths, is constant. Since the vertical field gradient $\Gamma = dH/dZ$ = constant, $H$ is directly proportional to $Z$, the vertical distance in the gap, so that:

$$\rho fa = \rho f + \frac{\chi \Gamma^2 Z}{g}$$

The apparent density of a pool of this ferrofluid in the gap of a constant gradient magnet will increase linearly from the top to the bottom of the pool. This ferrofluid pool is essentially a stable density gradient column. The operable density range can be varied either by varying $\chi$ or $Z$. The gap of a 5000 oe/cm constant gradient magnet in which the field increases linearly with distance from zero to a maximum value approaching the saturation or iron, i.e. $H_{max} \simeq 20{,}000$ oe, will be less than 4 cm in height.

The working height of a pool of ferrofluid placed in the gap will be approximately 2 cm. Effective separations may be obtained in such a magnetic over the density ranges of interest if an apparent density gradient of about 2.5 gr/cm$^3$-cm is imposed on the ferrofluid. This can be achieved with a ferrofluid susceptibility of $\chi \simeq 10^{-4}$. A perfluorinated ferrofluid whch contains about 0.5 volume percent magnetite will exhibit this susceptibility (this ferrofluid is the basis for FIG. 6). The essentially linear magnetization curve shown in FIG. 7 is followed.

The density gradient achieved by practice of this invention is distinguished from the varible density concepts set out by U.S. Pat. No. 3,483,966. Changing the magnetization level (as is taught in that patent) sequentially to separate out different components of a mixture involves magnetizing the ferrofluid to different levels along the flat portion of the curve shown in FIG. 5. Hanging an intermediate fraction inside the ferrofluid requires, and floating the light fraction, as is also suggested by the patent requires that the top of the ferrofluid column to be somewhere below the knee of the FIG. 5 curve. The variable density manifestly does not vary essentially linearly top to bottom, i.e. is not a density gradient as has been achieved by practice of this invention.

Figure 8:
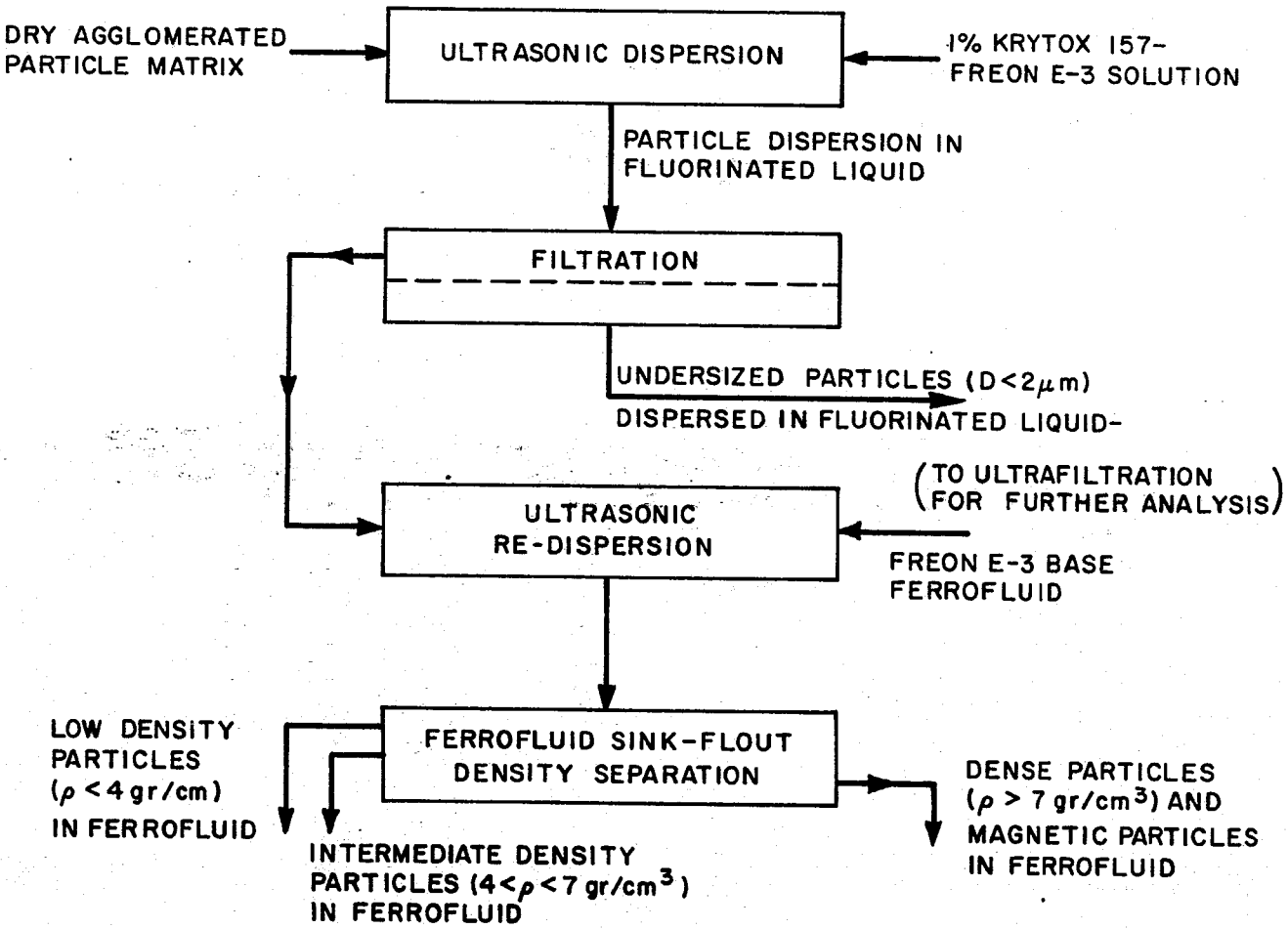
FIG. 8 is a schematic flow diagram of a process incorporating the present invention.

Particle separation according to practice of the present invention is schematically shown in FIG. 8.

A collected powder sample containing particles of interest is first ultrasonically agitated in a 1% solution of KRYTOX 157 in FREON E-3 until the particles in the sample are completely dispersed. If desired, coarse particles of significantly greater or lower density than the fluorinated solution ($\rho = 1.8$ gr/cm$^3$) may be separated from the rest of the suspended particles by simple sedimentation. The low density fraction, which would float to the top of the dispersion would consist mainly of organic particles of natural origin.

After this preliminary treatment, the particles still in suspension may be separated into two size fractions by filtration through an appropriately sized filter membrane of known pore size. The filtrate contains particles smaller than about 1 $\mu$m – 2 $\mu$m in diameter (considered too small to be of interest). The particles retained by the filter are those to be classified according to density in a ferrofluid separator. The filter is first carefully washed with additional 1% KRYTOX 157 – FREON E-3 solution and the particles redispersed. At this stage, it is anticipated that one is dealing typically with about 10 ml of liquid.

A small amount of concentrated ferrofluid is now added to the dispersion to transform the carrier liquid into a ferrofluid with a lower magnetization. The ferrofluid that is added is a FREON E-3 dispersion of KRYTOX 157 – stabilized magnetic particles that have an effective magnetic core diameter of about 30 A (3 nm). The magnetic particle concentration in the resulting mixture is about 0.1 volume percent.

The mixture is then transferred into a suitable separation vessel which is placed in the working gap of an electromagnet designed to generate a constant magnetic field gradient over the entire working volume, such as for example the electromagnet structure disclosed in copending and commonly assigned application, "Hyperbolic Magnet Poles for Sink-Float Separators", filed Mar. 25, 1974. Under the influence of the magnetic field, the ferrofluid has a varying apparent density which is higher than its true density of 1.8 gr/cm$^3$. A vertical density gradient is thus established in which the apparent density of the ferrofluid increases, for example, from less than 3 gr/cm$^3$ at the top of the separation vessel to more than 7 gr/cm$^3$ at the bottom of the vessel. A given particle sinks or floats in the column of ferrofluid until it attains a level of equal apparent density. Consequently, particles of different densities will be separated vertically. After allowing sufficient time for the system to approach equilibrium, the ferrofluid volume may be physically subdivided into three stratified cuts,, each of which contains particles of different densities. The top cut contains particles of density less than 4 gr/cm$^3$, the center cut contains particles ranging in densities from 4 gr/cm$^3$ to 7 gr/cm$^3$, and the bottom cut contains particles denser than 7 gr/cm$^3$, as well as magnetic particles that cannot be levitated in a ferrofluid.

The classified particles of interest can be separated from the much smaller magnetic particles of the ferrofluid by filtration. Residual ferrofluid is removed by washing the filter with a 1% KRYTOX 157 – FREON E-3 solution. Depending on the subsequent methods of analysis to be used, the particles on the filter may be recovered as a fluorinated suspension or may be deposited on a filter.

The last recovery step may be slightly modified for the high density fraction which also contains coarse ($D \simeq 1$–$2\mu$m), magnetically responsive particles. After the ferrofluid particles are removed, the particles are redispersed in a 1% KRYTOX 157 – FREON E-3 solution. The magnetically responsive particles can be selectively removed by application of magnetic forces. The magnetic and non-magnetic solid fractions can be further analyzed individually.

Although the detailed structure of sink-float separator equipment does not form part of this invention, manifestly any actual separation is constrained by equipment considerations, such as, for example, the working volumes available in a high intensity constant gradient magnet. Further elaboration on the principles and practices of this invention are best considered in light of magnetic equipment available to the art. Reference is again made to the structure disclosed in copending and commonly assigned application, "Hyperbolic Magnet Poles for Sink-Float Separators", filed Mar. 25, 1974, as an exemplary magnet adapted for a batch separation of small (analytical) samples, i.e. 1–10 mg, containing particles as little as 1 $\mu$m–2$\mu$m, density from less than 3 gr/cm$^3$ to more than 7 gr/cm$^3$. The expected concentration of sample particles in the ferrofluid is of the order of 0.1%. Approximately 1 ml–10 ml of ferrofluid is required. It may be noted that sink-float separation of such a sample is consistent with a high intensity constant gradient magnet having a working height and width limit of about 2 cm. The gap length can be greater, e.g. 20 cm. Once the sample has been classified, the separated fractions can be maintained separate by insertion of horizontal barriers (at predetermined density levels) and the different cuts removed individually, e.g. by flushing out each cut separately with fresh ferrofluid.

Further constraints on a fine particle separation arise from considerations of the characteristic separation times and distances, and of possible thermal and mechanical disturbances. Consider first the question of separation time. If the apparent density of the ferrofluid is uniform a powder particle, upon being injected into the ferrofluid, will very rapidly achieve a terminal velocity, $V$, given by the following equation:

$$V = \frac{D^2 \Delta\rho g}{18\eta}$$

where:

$g$ = acceleration due to gravity $\eta$ = viscosity of the ferrofluid $\Delta\rho$ = difference between the density of particle and the apparent density of the ferrofluid $D$ = particle diameter For $\Delta\rho$=0.5 gr/cm$^3$ $\eta$=0.05 poise, and $D$=2 $\mu$m, the settling velocity is about $2 \times 10^{-5}$ cm/sec. In order that the powder particles move a sufficient distance (1 mm, say), such that a mechanical separation of the dense and light fractions of the powder laden ferrofluid can be made, it is necessary then to wait several hours until the separation is achieved. In the powder separation device, however, the apparent density will more likely be a function of vertical position for reasons having to do with the stability of the ferrofluid dispersion. If a powder particle thus finds itself in the ferrofluid separator under conditions where the ferrofluid magnetization ($M$) is a function of the applied magnetic field ($H$) then it can be shown that the particle will migrate to that position in the ferrofluid at which the apparent ferrofluid density equals the density of the particle. The particle exponentially approaches the equilibrium position with a characteristic time given by:

$$\tau = \frac{9}{2} \frac{\eta}{D^2} \frac{1}{g} \frac{h}{\Delta\rho}$$

where:

$h$ is the vertical extent of the separator and $\Delta\rho$ is the net difference of apparent densities across the column. Again, for values appropriate to powders and available ferrofluids, this characteristic time is of the order of a few hours. The fact that the particles asymptotically approach their final position has implications for the separation accuracy.

If a particle of density 5 gr/cm$^3$ finds itself initially at the top of the device then it will asymptotically approach a line corresponding to a density of 5 gr/cm$^3$ and will approach that line closer as time proceeds, but will still remain above that line. This "fuzziness" in the separation can be minimized for a given system by selecting an appropriately long separation time. Assuming a separation height of 2 cm and a ferrofluid viscosity of 0.05 poise and a density difference $\Delta\rho$=1gr/cc, a 2 $\mu$m particle will be within ⅓ of a centimeter of its equilibrium position after 2 hours and within 0.05 cm after 6 hours.

Since the migration velocities for the proposed system are small it becomes necessary to consider the effect of thermal and mechanical disturbances on the operation of the system. If, for example, macroscopic convection currents were established in the separator, the swamping of the particle migration velocities by the convection velocity would render the device ineffective. There are several thermal instabilities associated with these fluids which occur when the ferrofluid is subjected to a thermal gradient in the direction of either gravity or the applied magnetic field and which can give rise to macroscopic convection. These stabilities will set in when the temperature difference is a fraction of a degree for the devices considered ($\Delta T$=0.1°C.). These instabilities can be prevented, however, if the fluid container is thermally jacketed so that the fluid is either isothermal or is slightly cooled in the direction of gravity and/or the applied magnetic field gradient.

It is not expected that random mechanical vibrations of the device will interfere with the separation, despite the very small particle migration velocites involved. The mechanical vibrations will establish oscillating flow patterns in the fluid but, presuming the vibration does not give rise to actual convection cells, the net particle migration associated with this oscillating flow should be quite small.

From the preceeding description of the preferred embodiments, it is evident that the objects of the invention are attained and although the invention has been described and illustrated in detail, it is to be clearly understood that the same is by way of illustration and example only and is not to be taken by way of limitation. The spirit and scope of the invention being limited only by the terms of the appended claims.

What is claimed is:

1. A method of constructing a density gradient column in a ferrofluid comprising the step of:

supplying a column of ferrofluid having a magnetization magnetic field intensity curve which includes a saturation region; and passing a constant gradient magnetic field through the ferrofluid, the maximum level of said magnetic field being below said saturation region.

2. A method of separating small diameter substantially non-magnetic particles having a diameter of 1 mm or less of different densities comprising:

immersing said particles in a ferrofluid having a magnetic saturation of 100 gauss or less;

applying a magnetic field of sufficient magnitude to produce a magnetic gradient capable of overcoming the forces produced by gravity to levitate the particles in said ferrofluid; and said magnetic field being a constant gradient field of a level lower than the magnetic saturation level of said ferrofluid whereby the ferrofluid is formed into a density gradient column and each non-magnetic particle therein levitates to a level in said ferrofluid having substantially the same apparent density as said particle.

3. A method as in claim 1 wherein the magnetic particles of the ferrofluid have a mean effective magnetic core diameter of less than about 50A angstroms and a stabilizing agent layer thereon exceeding about 30A angstroms.

4. A method as in claim 1 wherein said magnetic gradient is greater than 1,000 oersted/centimeter.

5. A method as in claim 1 wherein the non-magnetic particles in said ferrofluid exhibit a ratio of particle attraction forces ($F_{ss}$) to particle separation forces ($F_1$) applied by said magnetized ferrofluid of less than 10, based on a computation $$\frac{F_m}{F_t} = \left(\frac{1}{8\pi}\right)\left(\frac{(4\pi M)^2}{(\rho_2 - \rho_1)\, g^D}\right)$$

where:

$a$ = center to center spacing between particles $D$ = diameter of the particles $M$ = magnetic dipole moment per unit volume of ferrofluid $\rho 2$ = density of the more dense particles $\rho 1$ = density of the less dense particles $g$ = acceleration of gravity.

6. A method as in claim 1 wherein the ferrofluid is temperature controlled to an essentially constant temperature during the separation.

* * * * *

UNITED STATES PATENT OFFICE

CERTIFICATE OF CORRECTION

PATENT NO. : 3,951,784

DATED : April 20, 1976

INVENTOR(S) : Robert Kaiser, Leon Mir, Richard A. Curtis

It is certified that error appears in the above-identified patent and that said Letters Patent are hereby corrected as shown below:

Column 3, line 17, please change "$F_{22}$" to ---$F_{ss}$---.

Column 5, line 7, please change "the" to ---then---.

Column 5, line 64, please insert ---/--- between "$F_{ss}$ and $F_1$."

Columns 5 and 6 in Table I under the column, A (Eq. 2) a = D, line 3, please change "21:1" to ---21.1---.

Column 7, line 14, please insert ---/--- between "$F_{ss}$ and $F_1$."

Column 7, line 48, please change "$F_{22}$" to ---$F_{ss}$---.

Column 8, line 55, please insert "magnetic" after "mirror pole."

Column 10, line 1, please change "T" to ---$\Gamma$---.

Signed and Sealed this

Twentieth Day of July 1976

[SEAL]

*Attest:*

RUTH C. MASON
*Attesting Officer*

C. MARSHALL DANN
*Commissioner of Patents and Trademarks*